US009725835B2

(12) United States Patent
Vaglio Tessitore

(10) Patent No.: US 9,725,835 B2
(45) Date of Patent: Aug. 8, 2017

(54) DUAL-LAYER FABRIC, IN PARTICULAR FOR SPORTS AND UNDERWEAR, WITH IMPROVED BREATHABLE AND INSULATING PROPERTIES

(75) Inventor: Filippo Vaglio Tessitore, Biella (IT)

(73) Assignee: FILIPPO VAGLIO TESSITORE, Biella (IT)

( * ) Notice: Subject to any disclaimer, the term of this patent is extended or adjusted under 35 U.S.C. 154(b) by 1035 days.

(21) Appl. No.: 13/535,289

(22) Filed: Jun. 27, 2012

(65) Prior Publication Data

US 2013/0000011 A1 Jan. 3, 2013

(30) Foreign Application Priority Data

Jun. 29, 2011 (IT) ..... BI2011U0003

(51) Int. Cl.
*D04B 1/16* (2006.01)

(52) U.S. Cl.
CPC ..... *D04B 1/16* (2013.01); *D10B 2403/0114* (2013.01); *D10B 2403/021* (2013.01); *Y10T 442/431* (2015.04); *Y10T 442/475* (2015.04); *Y10T 442/488* (2015.04)

(58) Field of Classification Search
CPC ..... D04B 1/14; D04B 1/22; D04B 1/24
See application file for complete search history.

(56) References Cited

U.S. PATENT DOCUMENTS 3,250,095 A 5/1966 Bird
5,065,600 A * 11/1991 Byles ..... A61F 13/15577 66/193
5,284,031 A * 2/1994 Stoll ..... D04B 1/22 66/196
5,297,296 A * 3/1994 Moretz ..... A41B 9/004 2/170
5,312,667 A * 5/1994 Lumb ..... D04B 1/24 428/91
5,422,153 A * 6/1995 Miyamoto ..... D04B 21/02 428/116
5,461,884 A * 10/1995 McCartney ..... A43B 1/04 36/43

(Continued)

FOREIGN PATENT DOCUMENTS

DE 19635170 9/1997
EP 2540886 1/2013

OTHER PUBLICATIONS

European Search Report dated May 19, 2014 for EP Application 12004888.9 filed on Jun. 29, 2012 in the name of Filippo Vaglio Tessitore.

(Continued)

*Primary Examiner* — Danny Worrell
(74) *Attorney, Agent, or Firm* — Steinfl + Bruno LLP

(57) ABSTRACT

A knitted dual-layer fabric for manufacturing garments such as underwear and sportswear for wearing in the outdoors is described. The dual-layer fabric comprises a first layer, the first layer being an inner layer adapted to be in contact with the skin and having water repellent or hydrophobic properties, and a second layer, the second layer being an outer layer having hydrophilic or water absorbent properties, and a binding interposed between the inner layer and the outer layer to bind and tie the layers.

11 Claims, 4 Drawing Sheets

(56) References Cited

U.S. PATENT DOCUMENTS

| | | | | | |
|---|---|---|---|---|---|
| 5,547,733 | A * | 8/1996 | Rock | B32B 5/26 | 2/400 |
| 5,651,244 | A * | 7/1997 | Lucca | D01H 5/72 | 57/315 |
| 5,735,145 | A | 4/1998 | Pernick | | |
| 5,746,013 | A * | 5/1998 | Fay, Sr. | A43B 1/04 | 36/10 |
| 5,787,503 | A * | 8/1998 | Murphy, III | A41D 1/04 | 2/90 |
| 6,151,928 | A * | 11/2000 | Anyon | D04B 1/16 | 66/193 |
| 6,427,493 | B1 * | 8/2002 | Kasdan | D04B 1/16 | 66/169 R |
| 6,918,140 | B1 * | 7/2005 | Cooper | A41D 1/084 | 2/228 |
| 6,955,999 | B1 * | 10/2005 | Boye | A41D 13/0053 | 139/409 |
| 6,959,564 | B2 * | 11/2005 | Miller, III | A41B 9/004 | 66/177 |
| 6,986,270 | B2 * | 1/2006 | Miller, III | D04B 1/14 | 442/308 |
| 7,008,887 | B2 * | 3/2006 | Rearick | A41D 31/00 | 428/292.1 |
| 7,169,720 | B2 * | 1/2007 | Etchells | A43B 1/0045 | 428/109 |
| 7,360,378 | B2 * | 4/2008 | Foshee | D04B 1/14 | 66/196 |
| 7,465,683 | B2 * | 12/2008 | McMurray | D04B 21/04 | 442/152 |
| 7,611,999 | B2 * | 11/2009 | McMurray | D04B 1/102 | 442/304 |
| 7,937,973 | B2 * | 5/2011 | Sorensen | A61F 13/04 | 66/196 |
| 8,088,698 | B2 * | 1/2012 | Polegato Moretti | A41D 31/02 | 428/167 |
| 8,127,575 | B2 * | 3/2012 | Burrow | A61F 13/537 | 66/176 |
| 8,790,287 | B2 * | 7/2014 | Evans | A61F 13/041 | 442/304 |
| 2002/0102895 | A1 * | 8/2002 | Willard | B32B 5/26 | 442/244 |
| 2004/0168479 | A1 * | 9/2004 | McMurray | D02G 3/326 | 66/202 |
| 2007/0093162 | A1 | 4/2007 | Holcombe et al. | | |
| 2012/0177904 | A1 * | 7/2012 | Gehring, Jr. | D04B 21/10 | 428/220 |

OTHER PUBLICATIONS

European Communication dated May 12, 2015 for EP Application 12004888.9 filed on Jun. 29, 2012 in the name of Filippo Vaglio Tessitore.

European Patent Office Communication pursuant to Rule 71(3) EPC for Application No. 12 004 888.9-1710 filed on behalf of Filippo Vaglio Tessitore. Mailed Sep. 17, 2015, 55 pages.

Elmogahzy "Compact Spinning Dr Yehia Elmogahzy" Retrieved from: https://www.youtube.com/watch?v=sB5pcoVfkrU on Oct. 5, 2016. Upload Date: Feb. 25, 2014. Copyright 2005. 10 pages.

Basal, et al. "Comparison of Properties and Structures of Compact and Conventional Spun Yarns" Textile Research Journal 2006 vol. 76, No. 7; pp. 567-575.

Wan, et al. "Pilling properties of wool single jersey made of compact and conventional ring yarns after anti-felting treatment" Textile Research Journal 2014; vol. 84, No. 7; pp. 673-683.

Kamble "Compact Spinning System—Advantages and Disadvantages of Compact Spinning" Retrieved from http://textilelearner.blogspot.it/2013/02/compact-spinning-system-advantages-and.html on Oct. 5, 2016. Copyright 2014. 6 pages.

Prof. Khijwania "3.9: Compact Spinning" Textile Engineering module. Retrieved from http://nptel.ac.in/courses/116102038/29 on Oct. 5, 2016. Course first available: Jul. 16, 2013. Copyright 2009-2011. 10 pages.

X-Compact; "ActiveYarn: Active-wear" Retrieved from http://www.eurolast.it/public/ACTIVEYARN%20-%20COMPACT%20-%20MERCERIZED%20-%20CHLORINEFREE.pdf on Oct. 10, 2016. 7 pages.

"Determination of the properties of water absorption of a fabric: Water Absorption Ratio" Biella Qualita Totale S.R.L. Mail Date: Sep. 12, 2014. 6 pages. (Italian original + English translation).

Singh et al. "Spinning & Weaving: Different technologies to spin compact yarns" Retrieved from http://www.indiantextilejournal.com/articles/FAdetails.asp?id=503 on Oct. 5, 2016. First published in The Indian Textile Journal, Aug. 2007, 8 pages.

Trajkovic et al. "Spinning & Weaving: Conventional vs compact ring-spun yarn" Retrieved from http://www.indiantextilejournal.com/articles/FAdetails.asp?id=1206 on Oct. 5, 2016. First published in The Indian Textile Journal, May 2008, 9 pages.

Mashaly et al. "The Production Technology for Fine Egyptian Compact Yarns" Retrieved from https://www.youtube.com/watch?v=b8j3um01z8k&feature=youtu.be on Oct. 5, 2016. Upload Date: Feb. 29, 2016. 9 pages.

Test Reports 5983, 5984, 5985 with respective images—Biella Qualità Totale s.r.l.—Date: Apr. 11, 2017—Article: fabric made of conventional *Wool Non Compact Yarns*—6 pages.

Test Reports 5986 5987 5988 with respective images—Biella Qualità Totale s.r.l.—Date: Apr. 11, 2017—Article: fabric made of *Wool Compact Yarns*—6 pages.

Determination of the water absorption properties of a textile "Water absorption ratio"—Biella Qualità Totale s.r.l.—Date: Apr. 11, 2017—Dual-layer fabric with inner hydrophobic layer of continuous polypropylene. 3 pages.

Determination of the water absorption properties of a textile "Water absorption ratio"—Biella Qualità Totale s.r.l.—Date: Sep. 12, 2014—Dual-layer fabric with inner hydrophobic layer of discontinuous polypropylene. 2 pages.

* cited by examiner

DUAL-LAYER FABRIC, IN PARTICULAR FOR SPORTS AND UNDERWEAR, WITH IMPROVED BREATHABLE AND INSULATING PROPERTIES

CROSS REFERENCE TO RELATED APPLICATIONS

The present application claims priority to Italian Patent Application No. BI11U000003, filed on Jun. 29, 2011, which is herein incorporated by reference in its entirety.

FIELD

The present disclosure generally relates to textile fabrics. In particular, the disclosure relates to textile fabrics with thermal insulation and breathability properties which can allow a good thermal insulation and a good transpiration once worn and in contact with human skin. More particularly the disclosure relates to a knitted, dual layer fabric which can be used for the clothing (e.g. underwear and sportswear) which and can enhance and properties of thermal insulation and breathability of the clothing and can provide the clothing with antibacterial, hypoallergenic and antistatic properties.

SUMMARY

According to an aspect of the disclosure a knitted dual-layer fabric is described. The knitted dual-layer fabric comprises: a first layer, the first layer being an inner layer adapted to be in contact with skin of a user and having water repellent and/or hydrophobic properties; a second layer, the second layer being an outer layer having hydrophilic or water absorbent properties; and a binding yarn connecting and binding together the inner layer and the outer layer; wherein: the inner layer comprises synthetic yarn, and the outer layer comprises at least one of wool yarns or wool/silk yarns.

The details of one or more embodiments of the disclosure are set forth in the accompanying drawings and the description below. Further embodiments of the disclosure will be apparent from the description and drawings, and from the claims.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Figure 1:
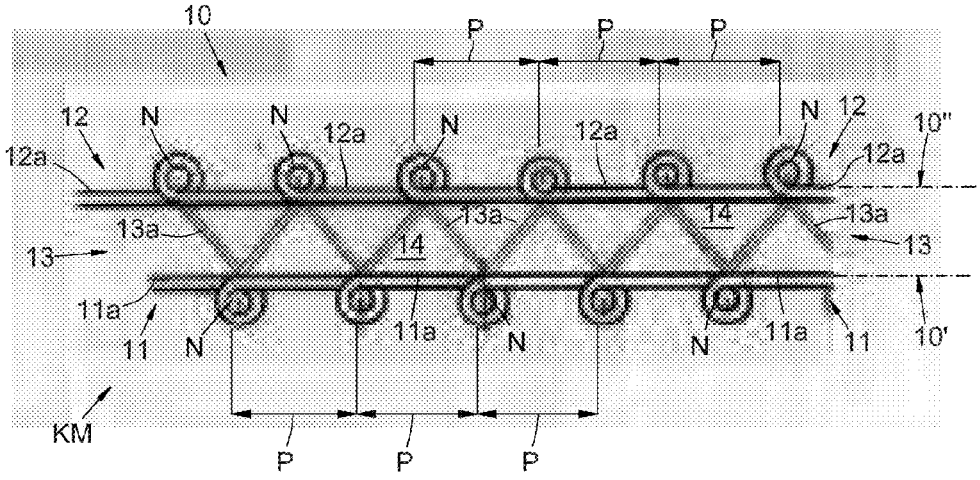
FIG. 1 shows a schematic view of a dual-layer fabric, according to embodiments of the present disclosure, manufactured by a knitting machine.

The textile field in general and in particular those of underwear, sport, medical and military, can offer a variety of products, articles and garments which can be made with fabrics having thermal insulation characteristics and properties, and at the same time can allow a good and effective transpiration of human sweat to the wearer, especially in relation to those sports that involve intense sweating and long times spent in the cold.

In this way these garments and items of clothing, for underwear and sports, which are offered and available in the market, tend to give the wearer a feeling of pleasure and physical well-being.

Among the fabrics commonly used to manufacture these articles and items of clothing, which are primarily intended for the field of the underwear and sport, there are the so-called "dual-layer" fabrics, or fabrics which can comprise two different layers, and in particular, an inner layer intended for contact with the skin, and an outer layer, with the two layers joined together in various ways, for example with a binding yarn or thread.

In these dual-layer fabrics, also referred to as "double-layer" or "double-face" fabrics, the inner layer in contact with the skin can exhibit water-repellent or hydrophobic properties in order to let liquids pass such as human sweat, while the outer layer can have hydrophilic properties, in order to absorb and retain the liquid.

In this way the double-layer fabric, due at least in part to an action and combined effects of the inner layer and the out layer, can create a good thermal insulation and at the same time can allow a good transpiration of sweat to the wearer, giving also a feeling of well-being to the wearer.

In known dual layer fabrics, usually both the inner layer and the outer are made with fibers, in particular synthetic fibers such as polyester and nylon.

These types of fibers can give rise to problems of allergy, can generate bad odours, and/or do not always give the effects that are desired by the user, for example a feeling of comfort and/or thermal insulation which can be relevant for those who are outdoors for extended periods of time.

Therefore, fabrics, and in particular double-layer fabrics, which can offer characteristics, for example, of thermal insulation and breathability, and a greater feeling of comfort for the wearer are desirable.

Therefore embodiments of the present disclosure describe dual-layer fabric, made of two different layers, wherein a first layer, the first layer being an inner layer adapted to be in direct contact with human skin is provided, and a second layer, the second layer being an outer layer adapted to face outwards is provided, to give a dual-layer fabric, wherein the dual-layer fabric can give comfort to the wearer, in terms of thermal insulation and perspiration ability.

According to further embodiments of the disclosure wool fibers and/or wool/silk fibers (wool in combination with silk) are used which can give a high degree of comfort for a wearer of the fiber and the fabrics made with the fiber.

Wool, as natural fiber which is currently not yet reproduced by any synthetic fiber, can be associated with specific properties, such as thermal insulation, absorption of liquids and temperature control, which appear not to be present in any of the previously developed synthetic fibers available on the market, and which can therefore can give a high feeling of comfort to the wearer.

Further characteristics of the dual-layer fabric according to embodiments of the present disclosure include, by way of example and not of limitation: thermal insulation, combined with breathability; a pleasant contact with the skin, substantially free from adverse effects, which can be due to an inner layer being made of a fiber with anti-bacterial, anti-allergic and anti-static nature; a wide and continuous feeling of comfort for the user, even while practicing sports that can involve intense perspiration; an ability to meet the needs of those who practice "outdoor" sports, and thereby can spend a long time in the open air; and a low manufacturing cost given that double-layer fabrics according to embodiments made on textile machines, and in particular on common knitting machines.

With reference to the drawings, a dual-layer fabric also referred to as double-layer or dual-face fabric, according to the present disclosure, is indicated with 10.

Wool, as a natural fiber can have both specific properties and characteristics and an ability to give a feeling of comfort to the wearer, that at least at the present time remains a desirable fiber and such comfort is generally not found in any known fibers and yarns of synthetic and artificial nature. A combination of a woolen fabric with a fabric made with synthetic fibers can provide a double-layer fabric having unique special effects and features as described herein.

Dual-layer fabrics 10 according to the disclosure are in some embodiments knitted, e.g. manufactured by a knitting machine, generally indicated with KM in FIG. 1, and comprise a first layer, the first layer being an inner layer 11, a second layer, the second layer being an outer layer 12, and a binding or ligature 13, interposed between the first layers 11 and the second layer 12, to bind them together. The inner layer is adapted to be in contact with skin of a user, and can have hydrophobic or water repellent properties being capable to repel wick and to not absorb liquids such as water. In some embodiments the inner layer can be any one of hypoallergenic, antibacterial and in some embodiments can have anti-static properties. In embodiments of the present disclosure, the second layer has hydrophilic properties, capable of absorbing liquids, such as water.

In some embodiments, the inner layer 11, being water-repellent, extends along an inner side 10' of the dual-layer fabric 10, and is also referred to as a "skin layer", because, as it is adapted to be in contact with the skin and a user's body on which the fabric 10 is worn.

In some embodiments, the outer layer 12 in turn extends along a corresponding outer side 10", opposite to the inner side 10', of the dual-layer fabric 10.

The dual-layer fabric 10 can be made, for example, on a linear or circular knitting machine (KM) with needles, according to substantially known methods starting from three series of yarns or threads, corresponding respectively to the inner layer 11, to the outer layer 12 and the binding 13.

In some embodiments, the two inner and outer layers 11 and 12, of the double-layer fabric 10, can respectively be made by a series of yarns or threads 11*a* and 12*a*, while the binding 13 can be made by a series of yarn or threads 13*a*.

For example, each yarn of each set of yarns can be fed, in the knitting machine by a corresponding feeding or supply unit, for example consisting of a supply or feeding cone.

In some embodiments, during each revolution of the linear or circular knitting machine KM, the yarns 11*a* and 12*a*, of each series of yarns, are controlled by respective series of needles, indicated with N in FIG. 1, arranged on two concentric circles of the knitting machine, and can then retrieved and fed in alternation by respective feeding cones.

In these embodiments, yarns 11*a* can intertwine with each other to form the inner layer 11, and yarns 12*a* can intertwine to form the outer layer 12.

In some embodiments, in parallel to the formation of the two layers, the yarns 13*a* of the series of threads corresponding to the binding 13, interposed between the two layers 11 and 12, can be controlled by the needles of the knitting machine, and can then be retrieved and fed in alternation from the respective feeding cones so as to form the binding 3.

In particular, in some embodiments, each binding thread 13*a* of the binding 13, interposed between the two layers 11 and 12, is controlled by the needles of the knitting machine so as to intertwine in alternation, for example, according to a zig-zag configuration, to the inner layer 11 and the outer layer 12, thus binding the two layers 11 and 12.

In these embodiments, the two inner and outer layers 11 and 12 can be kept separate, during manufacturing, by the binding 13 and by the respective yarns 13*a*, so as to form between them a hollow space indicated with 14.

Therefore, in some embodiments for an effect of progressive command of the needles arranged along a circle, the double-layer fabric 10, manufactured on circular knitting machine develops according to a tubular form.

For clarity, FIG. 1 shows a structure of a double-layer fabric 10 according some embodiments and in particular a double-layer fabric 10 as manufactured method described above.

As shown in FIG. 1, the inner layer 11 and the outer layer 12, and thereby also the respective yarns 11*a* and 12, can be spaced from one another by the binding 13, so as to form the hollow space 14.

Also in this embodiment, the inner layer 11 and the outer layer 12 can each have a drawing or a weave that corresponds to and is repeated with a same constant pitch P, according to which the needles N of the knitting machine N are arranged to form the inner layer 11 and those for the formation of the outer layer 12, of the circular knitting machine on which the double-layer fabric 10 is made.

In embodiments of the disclosure, each binding yarn 13*a* of the binding 13, interposed between the two layers 11 and 12, can have a zig-zag configuration, in which the yarn 13*a* binds itself, intertwining, in alternation to the inner layer 11 and the outer layer 12, at the constant pitch P, so as to bind the inner layer 11 and the outer layer 12.

Figure 2A:
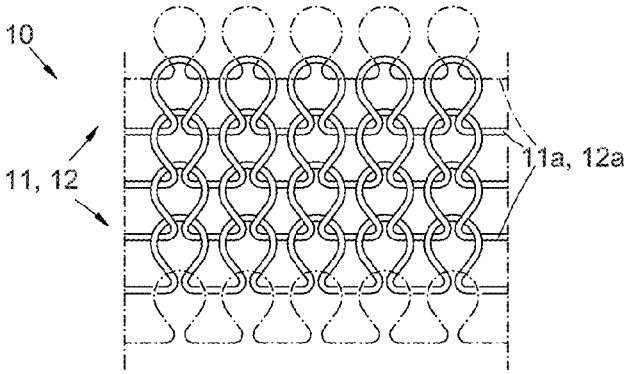
FIG. 2A shows a schematic view of the structure of the dual-layer fabric of FIG. 1 according to some embodiments.

FIG. 2A shows how the yarns 11*a* and 12*a* are intertwined in the inner layer 11 and the outer layer 12 according to some embodiments, following knitwear of the knitting machine.

By way of a non-limiting example, the double-layer fabric 10 can be made on a circular knitting machine provided with a total of 90 feeding points or falls, therefore, for a total of 90 yarns, with 30 drops or yarns 11*a* used for the formation of the inner layer 11, with 30 drops or yarns 12*a* for the formation of the outer layer 12, and with 30 drops or yarns 13*a* for the formation of the binding 13.

Other embodiments of the disclosure include other configurations identifiable by a skilled person, having a different total number of yarns and drops, and with a different mode of alternation of the intertwining of the binding yarns 13 with respect to the inner layer 11 and outer layer 12.

For example, according to some embodiments, each binding yarn 13*a*, instead of intertwining in alternation at the inner and outer layers in a pattern with a constant pitch, corresponding to that of the needles, can intertwine in such layers, in order to bind them, according to a multiple of that step, or to a particular sequence.

In some embodiments, the inner layer 11, being hydrophobic and/or water repellent, has yarns 11*a* which comprise synthetic threads, for example, polypropylene, and for example, having a metric count Nm typically between approximately 1/50 and 1/100.

Polypropylene, which the inner layer 11 is comprised of in some embodiments, can have a strong water-repellent and/or hydrophobic properties, which can lead to a very low absorption of liquids, together with a low coefficient of heat transmission, which in turn can reduce heat loss by the human body in a cold environment.

Further, polypropylene can be a suitable fiber for the inner layer 11 as it can have anti-bacterial, anti-static and non-allergenic properties, which can allow such fiber to substantially avoid allergic reaction on the skin and mucous membranes, even in sensitive individuals or to those with irritation problems due to skin contact with other fibers. Further, polypropylene can be a suitable fiber as it can substantially avoid generating odours.

In some embodiments, particularly in those using polypropylene as the inner layer 11, the yarn or threads 11*a* of the inner layer 11 can be made by discontinuous fiber yarns or continuous fiber yarns, and can be dyed in continuous or in paste, as would be understood by a skilled person.

In these embodiments, the fibrous structure of yarns 11*a* can promote, in conjunction with the water-repellent characteristics of the polypropylene, the capture of liquid by the inner layer 11, and in particular of sweat, caused by heat, and at the same time can allow a soft hand to make contact with the skin.

According to some embodiments of the disclosure, the outer layer 12, is hydrophilic and made of wool or wool/silk yarns or threads in an intimate blend, so as to provide physical characteristics of thermal insulation and others, as well as softness, which can be typical and unique of wool.

In particular the yarns of wool or wool/silk according to some embodiments can be obtained through a known spinning process, from wool fibers of the fine, extra-fine or superfine type with a diameter preferably between 16 and 17.5 microns, and having a metric count between Nm 1/50 and 1/110 or between 1/50 and 1/90.

Figure 2B:
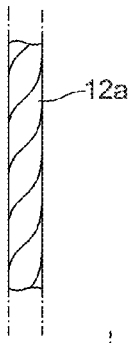
FIG. 2B shows a schematic view, in an enlarged scale, of a wool yarn which can be used to make the outer layer of the dual-layer fabric of FIGS. 1 and 2 according to some embodiments.

By way of example and for clarity, FIG. 2B shows in a schematic way a portion of a generic wool thread or yarn 12*a* comprised in the hydrophilic or water-absorbing outer layer 12.

In some embodiments the wool or wool/silk yarn 11*a* presents a typical twisted structure, which can be obtained with a spinning system exclusive and specific for the wool, for example, with an outer surface characterized by a special softness conferred by the fibers of wool or wool/silk that protrude from the surface.

In these embodiments, fibers present on the outer surface of the wool threads 12*a* of the outer layer 12, can favor absorption of liquids and particularly human sweat, which in turn can be captured and conveyed by the threads 11*a* of the outer layer 11.

In some embodiments the binding thread 13 is made by a synthetic yarn polyamide based, for example, nylon.

The double-layer fabric 10 according to some embodiments can be made in various combinations of yarn count of polypropylene yarn 11*a* and the threads of wool 12*a* comprised in the inner layer 11 and outer layer 12, respectively.

The following table shows some exemplary and non-limiting combinations of yarn count according to embodiments of the present disclosure.

| Metric Number (Nm) of the polypropylene yarns of the hydrophobic inner layer | Metric Number (Nm) of the wool yarns of the hydrophilic outer layer |
|---|---|
| from 1/50 to 1/70 | from 1/50 to 1/70 |
| from 1/90 to 1/110 | from 1/90 to 1/110 |

The wool threads 12*a* of the outer layer 12 can in some embodiments also contain an intimate blend of other fibers, for example, fibers of silk.

With respect to these embodiments, the following table shows some exemplary and non-limiting combinations between yarn count of the yarns of polypropylene and of wool/silk, and respective percentages of wool/silk according to the disclosure.

| Metric Number (Nm) of the polypropylene yarns of the hydrophobic inner layer | Metric Number (Nm) of the wool yarns of the hydrophilic outer layer | Wool/silk percentage in the hydrophilic outer layer |
|---|---|---|
| from 1/50 to 1/70 | from 1/50 to 1/70 | wool 70-90%, the rest silk |
| from 1/90 to 1/110 | from 1/90 to 1/110 | wool 70-90%, the rest silk |

In some embodiments, in the yarns comprised in the hydrophilic outer layer, the percentage of wool fibers is between 70% and 100%, with any remainder of the percentage of fibers consisting of silk fibers.

Wool yarn, with which the outer layer can be woven in the knitting machine, can be made by a compact spinning process, also called "compact" spinning, as compared to a conventional spinning process, can produce a different structure of yarn which can have effects, such as, a higher quality of the yarn itself, a more perfect circular structure of the yarn, a yarn which is more resistant, and yarn with minimal hairiness and having a good abrasion resistance.

Figure 2C:
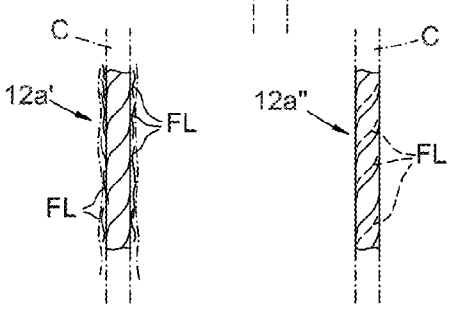
FIG. 2C shows a schematic comparing a wool yarn made with a conventional spinning process with a wool yarn made by a spinning process of the "Compact" type.

By way of example and for clarity, FIG. 2C shows a schematic comparison between a wool yarn, indicated with 12*a*', produced with a conventional spinning mode, with a wool yarn, indicated by 12*a*", made with the "compact" spinning process.

As can be seen from this FIG. 2C, while in the yarn 12*a*', obtained with a conventional spinning method, the wool fibers FL tend to protrude externally from the body C of the yarn 12*a*'; in the wool yarn 12*a*", produced with "compact" spinning method, the fibers FL are compacted and retained within the body C of the yarn.

The outer layer of wool according to some embodiments can be subjected to a treatment to substantially prevent or delay the so-called phenomenon of "pilling" by which the surface of a fabric of wool, through use, forms a fluff which over time tends to become tangled and give rise to tufts of fibers.

Furthermore, in some embodiments, the outer layer of wool can be subjected to a treatment directed to prevent "felting" and/or subjected to other types of treatment, such that the wool substantially retains its appearance even after repeated washing and drying of the wool, and such that the articles of clothing can also be worn without a need for rehabilitation and ironing.

In some embodiments, the outer layer of wool of the dual-layer fabric can be subjected to a treatment of mercerization.

Among the treatments to which the outer layer of wool can be subjected according to embodiments of the disclosure, a treatment known as "Total Easy Care" is included, which, similarly to a treatment of mercerization, can allow an for characteristics of breathability of the garment made with the dual-layer of fabric of the disclosure.

These mercerizing and/or "Total Easy Care" treatments to the outer layer of wool can also allow rapid drying times of the garment, compared to the garments made with wool fabrics which are not treated, and can also allow the garment to substantially avoid changing of the garments features of the outer layer of wool even after several washes in a washing machine.

A garment made according to some embodiments of the disclosure, with a double-layer fabric treated as described above can endure approximately 30 washes, and, in the case of mercerization treatment, can endure, in some embodiments, 50 or more washings.

In some embodiments the inner layer comprises meta-aramid fibers, which can substantially prevent melting of the inner layer in the presence of heat sources, for example through contact with incandescent bodies, and thus can avoid epidermal burns due to fusion of the inner layer. By way of example and not of limitation, the yarn comprising aramid fibers can be composed of 95% meta-aramid fibers and from 5% of aramid fibers.

Therefore, in embodiments where the garments are adapted to be used for military purposes, fire rescue fields, and in general for rescue personnel, aramid materials can be used for the inner layer 11 of the dual-fabric 10.

Double-layer fabrics of the disclosure can be adapted to present visually and physically different features and configurations, on both sides, depending on an intended use as would be understood by a skilled person.

For example, in some embodiments the double-layer fabric can be smooth on one side, in particular on the outer layer and can perforated on the inner layer, like a net or with a waste of needle.

In some embodiments, the double-layer fabric 10 of the disclosure can be used to manufacture a wide range of garments and articles, in particular for underwear and sport, adapted to be worn with the inner layer 11 of the dual-layer fabric 10 in direct contact with skin of the human body.

FIGS. 5A-5G show some exemplary garments which include but are not limited to T-shirts, overalls, shorts, and socks made with the double-layer fabric 10 of the disclosure.

When these garments are worn, the two layers 11 and 12 of the fabric 10, with which they are manufactured, can act synergistically. A synergistic action of the inner layer 11 and the outer layer 12, according to some embodiments, is now described by way of example and not of limitation.

For example, the inner layer 11, comprising synthetic threads, in contact with the skin of a wearer, can temporarily receive sweat from the wearer, but, being water repellent, does not absorb the sweat and instead transfers the sweat to the outer layer 12 of wool, which, being hydrophilic can attract and absorb the sweat.

In this way, the inner layer 11 can remain substantially dry, while the outer layer 12 can become wet and retain the sweat, thus giving a pleasant feeling of comfort to the wearer of this double-layer fabric 10, even in a case of intense sweating.

Moreover, the gap 14 formed between the two layers 11 and 12 can act as a thermal insulation and, adjusting heat exchange, thus substantially avoiding states of body cooling.

In other words, this gap 14 can allow dispersion of body heat to take place slowly, such that the human body is not subjected to thermal shock but rather can become accustomed to changes in temperature.

By way of example, in support of the foregoing description, and for clarity, the schematics shown in FIGS. 3A-3D show how the double-layer fabric according to embodiments of the disclosure can work, once worn in direct contact with the skin, and show the dual-layer fabric's properties of thermo insulation and thermo regulation according to some embodiments.

Figure 3A:
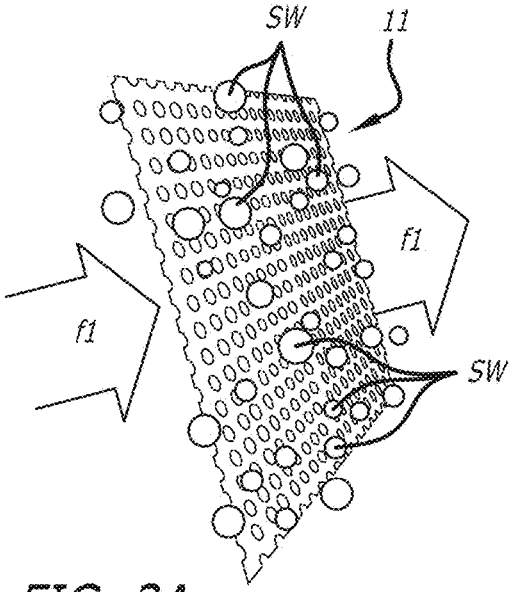
FIGS. 3A-3D show three-dimensional schematic diagrams which illustrate the thermo regulating and breathability properties of the dual-layer fabric according to embodiments of the present disclosure.

For example, FIG. 3A shows how an inner layer 11 of polypropylene, in contact with the skin and having antibacterial, anti-allergenic and anti-static properties, does not retain the sweat SW but rather pushes and transfer it to the outside, to the outer layer 12 of wool, in the direction indicated by arrows f1, according to some embodiments.

Figure 3B:
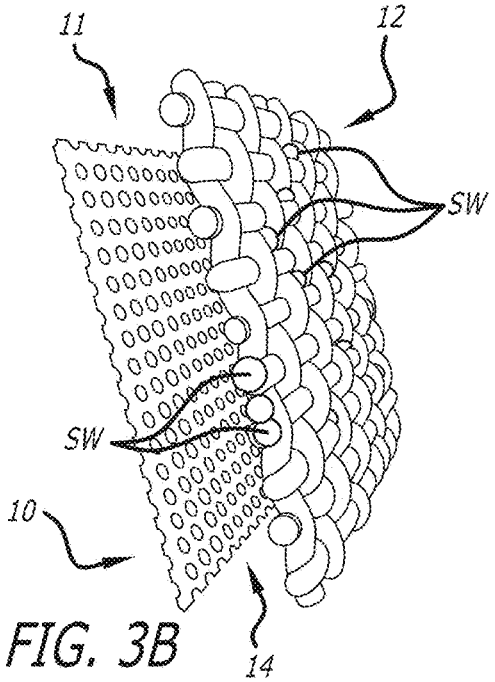

FIG. 3B, in turn, shows how the outer layer 12 of wool, for example fine wool with a fineness of the wool fibers between 16 and 17.5 micron, can collect and absorb the sweat SW on the outer surface of the double-layer fabric 10 according to some embodiments.

Figure 3C:
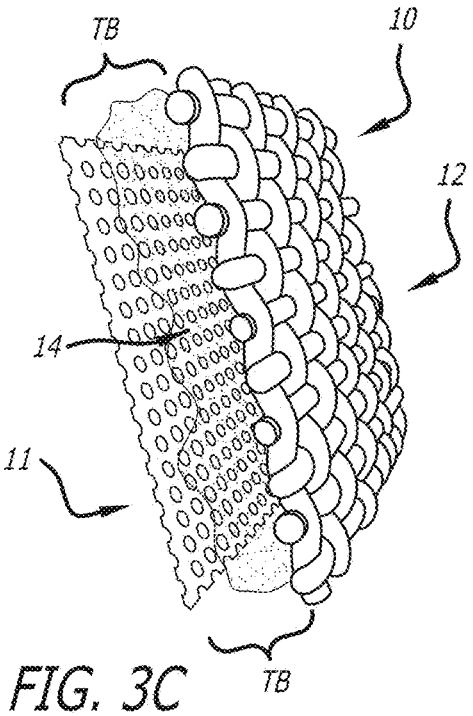

In this way, as shown in FIG. 3C, the gap 14 between the inner layer 11 and the outer layer 12 can form a true thermal barrier, indicated with TB, which can isolate the skin from the external environment according to some embodiments.

Figure 3D:
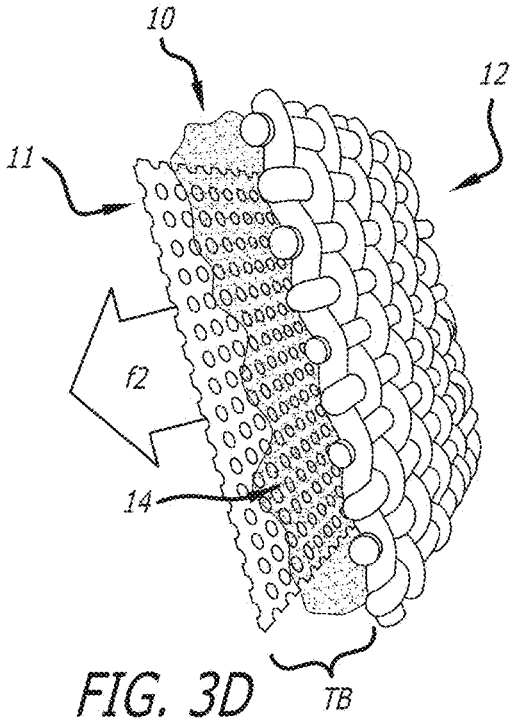

Therefore, as shown in FIG. 3D, the double-layer fabric 10 of the disclosure can provide an effective protection of the skin from thermal shock (e.g. substantially avoiding feelings of cold and/or moisture on the skin, thereby maintaining a substantially constant body temperature), indicated schematically with arrow f2.

Moreover the dual-layer fabric 10 according to some embodiments can substantially avoid generating unpleasant odors thus there can be less of a need to change the garment (e.g. underwear) even in conditions of critical and very intense sweating.

For example, military personnel in operation can avoid colds and chills, even after a long stretch hike or run, where the military personnel may be forced to wait long time with climate changes, without being able take off body armor and equipment or even having a chance to change clothes.

Figure 4:
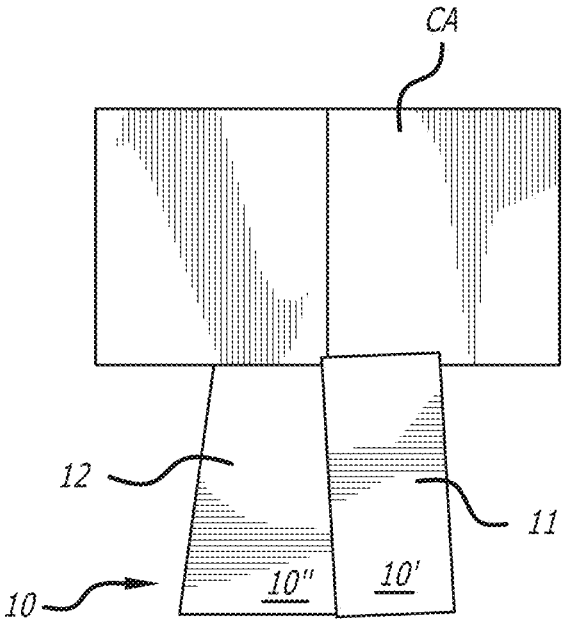
FIG. 4 shows a photographic image of a test carried out on a dual-layer fabric of the disclosure.
Figure 5A:
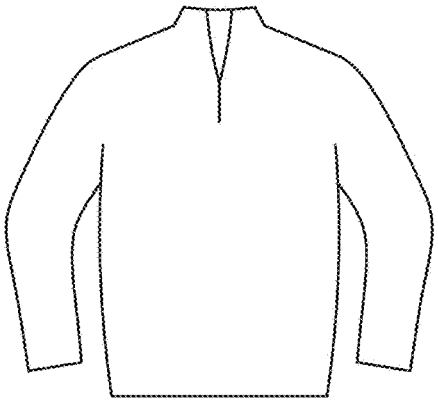
FIGS. 5A-5G show photographic images of some examples of clothing and garments made with the dual-layer fabric of the disclosure.
Figure 5B:
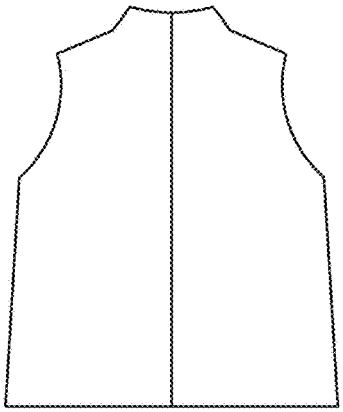
Figure 5C:
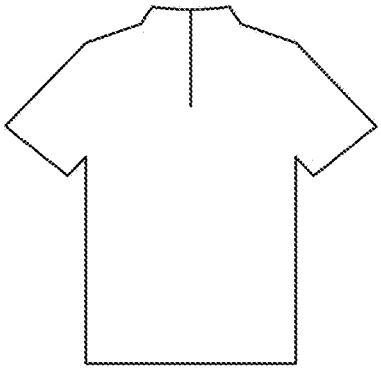
Figure 5D:
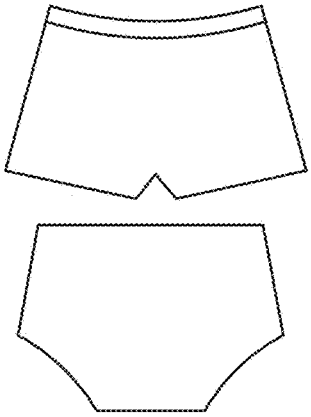
Figure 5E:
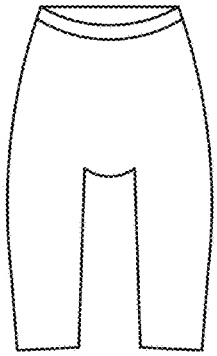
Figure 5F:
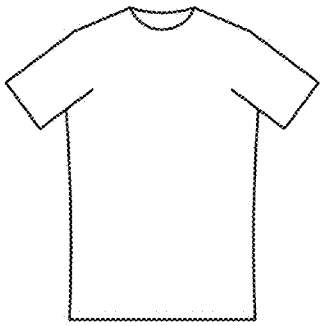
Figure 5G:
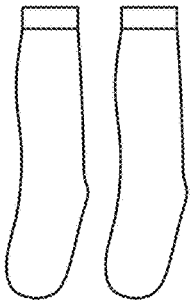

The photograph shown in FIG. 4 shows results of a test performed on a sample of the double-layer fabric 10, wherein the test comprises wetting or bringing the inner side 10', corresponding to the hydrophobic or water repellent layer 11 of polypropylene of the fabric 10, in contact with a liquid, and, after this operation, verifying with a sheet of absorbent paper CA, the state of wetness of the inner layer 11 and the outer layer 12.

As shown in the photograph of FIG. 4, and demonstrated by the appearance of the sheet of absorbent paper CA, the inner side 10' of the double-layer fabric 10, corresponding to the hydrophobic or water-repellent layer 11 of polypropylene, is completely dry.

On the contrary, the outer side 10" of the double-layer fabric 10, corresponding to the layer 12 of wool or wool/silk, being hydrophilic and water-absorbing, is wet.

Therefore, the test demonstrates that while using the double-layer fabric 10 according to embodiments herein described, the liquid, or sweat can be substantially totally absorbed and collected in the outer layer of wool 12, leaving the inner layer 11, made of polypropylene, substantially dry.

Therefore, the dual or double-layer fabric herein described can be particularly useful and suitable to manufacture garments and articles for underwear and sport, which can allow a wearer to have good thermal insulation and breathability of sweat and moisture, combined with a feeling of physical well-being and comfort.

The embodiments and details of manufacture of the dual-layer fabric as described herein can be widely varied without departing from the scope of the present disclosure, as would be understood by a skilled person. Some further embodiments are described below by way of example and not of limitation.

For example, the polypropylene yarn, with which the inner layer of the double-layer fabric is made according to some embodiments, can comprise continuous or discontinuous fibers or a mixture thereof with these two types of polypropylene yarn present in different percentages in the inner layer.

The yarn with which the water repellent inner layer 11 is made according to some embodiments, can be polyester or nylon.

In some embodiments, the double-layer fabric of the disclosure can be applied not only in the underwear and sports fields, but also in the medical and military fields.

The binding yarn or thread which binds the two layers of the double-layer fabric can be made, in some embodiments, of a common synthetic material, for example, a silver or a metallic yarn.

The examples set forth above are provided to give those of ordinary skill in the art a complete disclosure and description of how to make and use the embodiments of the Dual-Layer Fabric for Sports and Underwear, with Breathability and Insulation Properties of the disclosure, and are not intended to limit the scope of what the inventor regards as his disclosure. Modifications of the above-described modes for carrying out the disclosure can be used by persons of skill in the art, and are intended to be within the scope of the following claims.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications can be made without departing from the spirit and scope of the present disclosure. Accordingly, other embodiments are within the scope of the following claims.

What is claimed is:

1. A knitted dual-layer fabric, for use in underwear and sport, with improved breathable and thermal insulating properties, comprising:

a first layer, the first layer being an inner layer adapted to be in contact with skin of a user and having hydrophobic properties;

a second layer, the second layer being an outer layer having hydrophilic properties; and a binding yarn connecting and binding together the inner layer and the outer layer;

wherein:

the inner, hydrophobic, layer is made of polypropylene yarns, and the outer, hydrophilic, layer is made of wool yarns or wool/silk yarns;

the polypropylene yarns of said inner, hydrophobic, layer are made by discontinuous fibers, whereby the fibrous structure of these yarns in conjunction with the water-repellent characteristics of the polypropylene promotes the capture of liquid by the inner layer; and the wool or wool/silk yarns comprised in said outer, hydrophilic, layer are made with a so-called "compact" spinning process, as compared to a conventional spinning process, thereby exhibiting a different structure of the yarn over that of a conventional spun yarn, in which different structure fibers are retained and compacted in the body of the wool or wool/silk yarn and have a minimal hairiness;

whereby the inner layer of polypropylene, in contact with the skin, does not retain the liquid, as the sweat, but transfers it directly to the outer layer of wool or wool/silk with the effect that the sweat is substantially totally adsorbed and collected in the outer, hydrophilic, layer of wool or wool/silk, while leaving the inner, hydrophobic, layer of polypropylene substantially dry; and wherein:

the inner layer comprises a series of yarns and the outer layer comprises a series of yarns, each of the series of yarns being spaced and intertwined with a constant pitch;

the binding yarn has a configuration of a zig-zag pattern, in which the binding yarn is intertwined in alternation between the inner layer and the outer layer, thus binding the inner layer and the outer layer of the dual-layer fabric;

the wool yarns or wool/silk yarns comprised in the outer, hydrophilic, layer have a metric count between Nm 1/50 and Nm 1/200; and the outer, hydrophilic, layer of wool or wool/silk yarns is subjected to a mercerizing treatment.

2. The dual-layer fabric according to claim 1, wherein the binding yarn is made of a yarn selected from a polyamide-based yarn, or thread nylon yarn, a silver yarn, and a metal yarn.

3. The knitted dual-layer fabric according to claim 1, wherein the wool yarns or wool/silk yarns comprised in the outer, hydrophilic, layer are made of fibers of fine wool, or extra-fine wool, having a diameter between 16 and 17.5 micron.

4. The knitted dual-layer fabric according to claim 1, wherein the wool yarns or wool/silk yarns comprised in the outer, hydrophilic, layer have a metric count between Nm 1/60 and Nm 1/70, and the polypropylene yarns comprised in the inner, hydrophobic, layer have a metric count between Nm 1/60 and Nm 1/70.

5. The knitted dual-layer fabric according to claim 1, wherein the wool yarns or wool/silk yarns comprised in the outer, hydrophilic, layer have a metric count between Nm 1/90 and Nm 1/110, and the polypropylene yarns comprised in the inner, hydrophobic, layer have a metric count between Nm 1/90 and Nm 1/110.

6. The knitted dual-layer fabric according to claim 1, wherein the outer layer comprises wool/silk yarns having a percentage of wool between 70% and 100% with a remainder of the percentage consisting of silk.

7. A garment comprising the dual-layer fabric according to claim 1.

8. The garment according to claim 7, wherein the garment is selected from the group consisting of T-shirts, jackets, underwear, socks and pants.

9. A method comprising providing the dual-layer fabric according to claim 1, and manufacturing a garment with said dual-layer fabric.

10. The knitted dual-layer fabric according to claim 1 consisting only of said first inner layer and of said second outer layer without any additional fabric layers, and of said binding yarn connecting and binding together the inner layer and the outer layer.

11. A method for manufacturing a knitted dual-layer fabric, for use in underwear and sport, exhibiting improved breathable and thermal insulating properties, wherein the knitted dual-layer fabric comprises:

a first inner layer adapted to be in contact with the skin of a user and having hydrophobic properties, with said inner hydrophobic layer being made of polypropylene yarns, a second outer layer having hydrophilic properties, with said outer hydrophilic layer being made of wool yarns or wool/silk yarns; and a binding yarn connecting and binding together the inner layer and the outer layer;

wherein the polypropylene yarns of said inner, hydrophobic, layer are made by discontinuous fibers, whereby the fibrous structure of these yarns in conjunction with the water-repellent characteristics of the polypropylene promotes the capture of liquid by the inner layer; and wherein the wool or wool/silk yarns comprised in said outer, hydrophilic, layer are made with a so-called "compact" spinning process, as compared to a conventional spinning process, thereby exhibiting a different structure of the yarn over that of a conventional spun yarn, in which different structure fibers are retained and compacted in the body of the wool or wool/silk yarn and have a minimal hairiness;

whereby the inner layer of polypropylene, in contact with the skin, does not retain the liquid, as the sweat, but transfers it directly to the outer layer of wool or wool/silk with the effect that the sweat is substantially totally adsorbed and collected in the outer, hydrophilic, layer of wool or wool/silk, while leaving the inner, hydrophobic, layer of polypropylene substantially dry; and wherein:

the inner layer comprises a series of yarns and the outer layer comprises a series of yarns, each of the series of yarns being spaced and intertwined with a constant pitch;

the binding yarn has a configuration of a zig-zag pattern, in which the binding yarn is intertwined in alternation between the inner layer and the outer layer, thus binding the inner layer and the outer layer of the dual-layer fabric;

the wool yarns or wool/silk yarns comprised in the outer, hydrophilic, layer have a metric count between Nm 1/50 and Nm 1/200; and the outer, hydrophilic, layer of wool or wool/silk yarns is subjected to a mercerizing treatment.

* * * * *